United States Patent [19]

Ihata

[11] Patent Number: 4,902,305

[45] Date of Patent: Feb. 20, 1990

[54] SEMI-CYLINDRICAL METAL POLISHING ELEMENT

[75] Inventor: Sachiko Ihata, Osaka, Japan

[73] Assignee: Nippon Tenshashi Kabushiki Kaisha, Osaka, Japan

[21] Appl. No.: 323,720

[22] Filed: Mar. 15, 1989

Related U.S. Application Data

[62] Division of Ser. No. 60,589, Jun. 11, 1987, abandoned.

[51] Int. Cl.[4] ..... C23F 1/02

[52] U.S. Cl. ..... 51/293; 51/206 R; 51/5 D; 125/11 R

[58] Field of Search ..... 51/293, 397, 396, 395, 51/393, 392, 391, 207, 206.4, 206 NF, 206 P, 206 R, 205 R, 204, 5 D; 125/11 R, 11 CD

[56] References Cited

U.S. PATENT DOCUMENTS

| | | | |
|---|---|---|---|
| 1,109,401 | 9/1914 | Conrader | 51/DIG. 6 |
| 1,657,784 | 1/1928 | Bergstrom | 51/397 |
| 2,049,874 | 8/1936 | Sherk | 51/206 P |
| 3,559,315 | 11/1970 | Bidwell | 51/293 |
| 4,456,500 | 6/1984 | Ibata | 51/293 |
| 4,661,064 | 4/1987 | Beltramini | 51/206 P |

FOREIGN PATENT DOCUMENTS

| | | | |
|---|---|---|---|
| 929957 | 10/1955 | Fed. Rep. of Germany | 51/397 |
| 0000613 | 3/1959 | United Kingdom | 51/397 |

*Primary Examiner*—Frederick R. Schmidt
*Assistant Examiner*—Blynn Shideler
*Attorney, Agent, or Firm*—Griffin, Branigan, & Butler

[57] ABSTRACT

A metal polisher 1 is semi-cylindrical in shape to permit polishing a protruded or a recessed surface portion of a workpiece. A number of grooves 4 are formed circumferentially on a surface on which polishing teeth 3 are formed so as to temporarily store chipped dust arising from a polishing operation and drain the dust as stored.

1 Claim, 3 Drawing Sheets

33
39
38
39

30
32
8
31
35

1
30
32
34
33
38
8
36
37
2
4
3
37
8
1

SEMI-CYLINDRICAL METAL POLISHING ELEMENT

This is a division of application Ser. No. 060,589, filed June 11, 1987, now abandoned.

BACKGROUND OF THE DISCLOSURE

1. Field of the Invention

This invention relates to an improvement in metal polishers of the type used to polish a surface of an object to be polished. More particularly, the invention relates to a semi-cylindrical metal polisher suitable for polishing a concave face of an object to be polished (hereinafter referred to as a workpiece).

2. Background of the Invention

Metal polishers are known in the art and are disclosed in Japanese patent publication No. 1980-31206, Japanese applications laid open No. 1982-149128 and 1982-151477, and Japanese utility model applications laid open No. 1982-132656, 1983-69855, and 1983-69856. The metal polishers described in these documents are manufactured by applying photo etching and all are virtually flat in shape.

Conventionally, a flat metal polisher comprises a flat matrix and a plurality of very narrow polishing teeth integrally formed on the matrix. It has advantages in that it is more durable and polishes finer than sandpaper or a file and chips resulting from a polisher cause less clogging in the element than in sandpaper or a file.

Flat polishers may be satisfactorily employed to polish flat surfaces of a workpiece. However, when the surface of a workpiece is of a concave shape, it cannot be polished uniformly with a flat polisher.

SUMMARY OF THE INVENTION

An object of the present invention is to provide a semi-cylindrical metal polisher which is capable of polishing a workpiece uniformly even if the surface of the workpiece is concave.

A semi-cylindrical metal polisher according to the invention is characterized in that it comprises a semi-cylindrical metal matrix, many convex polishing teeth formed integrally with at least one surface of the inner and outer surfaces of the matrix, and a number of concave grooves extending circumferentially on the surface of the matrix on which the polishing teeth are formed. That is, a metal polisher according to the invention is semi-cylindrical and provided with concave grooves.

A concave surface of a workpiece is polished by the polishing teeth of the semi-cylindrical metal polishing element when it is moved on the workpiece with the polishing teeth abutting the concave surface. Chips which result from the polishing are deposited in the concave grooves or discharged from the concave grooves after being stored in the concave grooves. A semi-cylindrical metal polisher according to the invention offers the many advantages that a concave surface of a workpiece can be favorably polished because the shape of the matrix, on which the polishing teeth are integrally formed, is semi-cylindrical; chips which result from the polishing are deposited in, and/or discharged from, the concave grooves, so that the chips are prevented from accumulating between the polishing teeth; the teeth of the polisher are not heated as much during the polishing operating owing to a preferable ventilation caused by the provision of the concave grooves; and, since the concave grooves are formed by crushing a part of the polishing teeth, the matrix is thickened and strengthened where the grooves are formed thus enabling the polisher to maintain its shape.

BRIEF DESCRIPTION OF THE DRAWINGS

The foregoing and other objects, features and advantages of the invention will be apparent from the following more particular description of preferred embodiments as illustrated in the accompanying drawings in which reference characters refer to the same parts throughout the various views. The drawings are not necessarily to scale, emphasis instead being placed upon illustrating the principles of the invention.

DESCRIPTION OF THE PREFERRED EMBODIMENT

Figure 1:
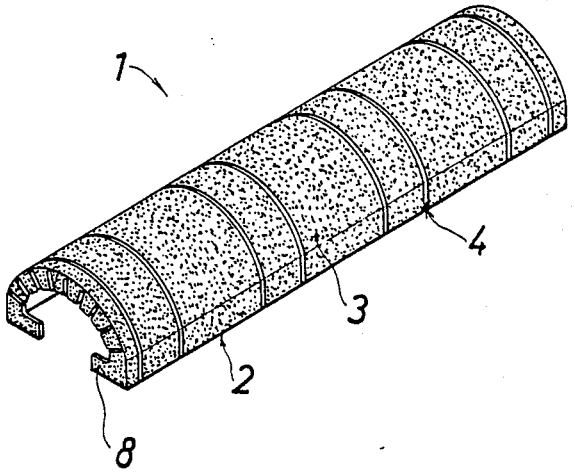
FIG. 1 is a perspective view of a semi-cylindrical metal polisher of an embodiment according to the invention.

As illustrated in the drawings, a semi-cylindrical metal polisher 1 constructed in accordance with the principles of the present invention comprises principally a matrix 2 of generally uniform thickness and having teeth formed on at least one surface thereof, teeth 3, and concave grooves 4 formed in the toothed surface. The matrix 2 is made of a metal in a hollow semi-cylindrical shape having a certain size and thickness. In the embodiment shown the matrix is approximately U-shaped in the vertical sectional view.

Figure 2:
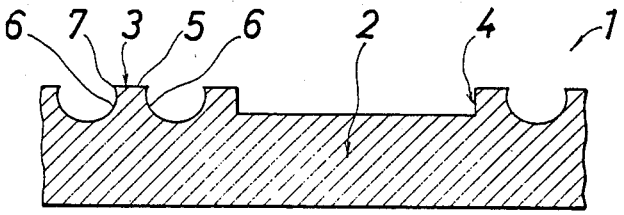
FIG. 2 is an enlarged vertical longitudinal sectional view of a semi-cylindrical metal polisher.

The polishing teeth 3 are very narrow and in the embodiment shown are formed at predetermined spaced intervals on only the outer surface of the matrix 2. The shape of the polishing teeth 3 is approximately semi-circular as shown in FIG. 2. The teeth 3 have flat top faces 5 which contact the surface of a workpiece during a polishing operation, circular side faces 6, and blades 7 formed at the boundary between faces 5 and 6. The cutting action angle (between the top and side faces of the tooth) of the blade 7 is acute.

A number of concave grooves 4 are circumferentially formed on the matrix 2 on the face where the polishing teeth 3 are disposed.

In the embodiment shown, the concave grooves 4 are disposed on only the outer surface of the matrix 2 at predetermined intervals in the axial direction of the matrix 2. The grooves are formed by crushing the polishing teeth 3.

Both end-faces, of the semi-cylindrical metal polishing element 1, in the longitudinal direction thereof, are bent inwardly so as to form portions to be mounted on a holder.

Figure 3:
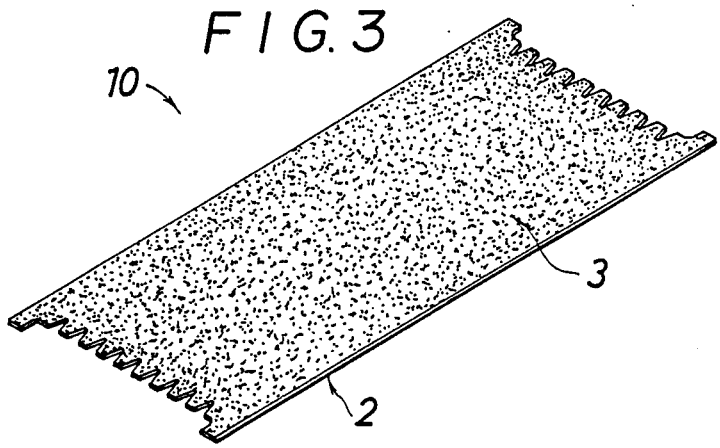
FIG. 3 is a perspective view showing a flat metal polisher which has been cut in order to be formed as a semi-cylindrical metal polisher.

The semi-cylindrical metal polisher 1 is formed from a flat metal polisher 10 (FIG. 3) of generally uniform thickness and cut to a predetermined shape. Flat metal polishers are manufactured by photo etching as disclosed in the documents referenced above, so that details of the photo etching are omitted herein.

Figure 4:
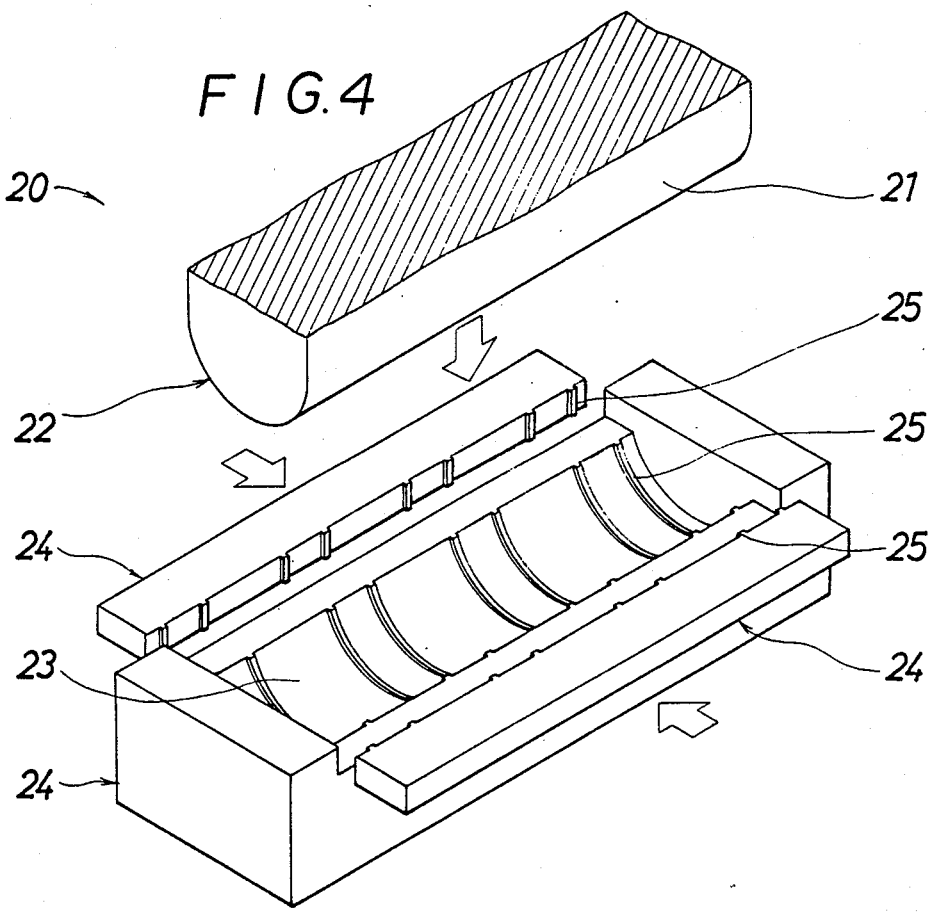
FIG. 4 is a schematic diagram showing a pressure die set which is to be used to form a semi-cylindrical metal polisher.

The flat metal polisher 10 is shaped into a hollow semi-cylindrical polisher of generally uniform thickness using a a pressure die set 20 shown in FIG. 4. The pressure die set 20 comprises a male die 22 having a convex surface 21 and a female die 24 having a concave face 23 mating with the male die 22. The female die comprises one main female die and two subsidiary female dies.

The pressure die 20 differs slightly from common pressure dies in that convex portions 25 are provided on the face of the female die which contacts with the polishing teeth 3. More specifically, a number of convex portions 25 are formed on a concave face 23 of the female die 24 at certain intervals in the axial direction of the female die 24 so that the convex portions 25 contact some of the polishing teeth 3 as the matrix is compressed between the male and female dies. The convex portions 25 are very narrow and protrude higher than the polishing teeth 3.

To form a semi-cylindrical metal polisher a flat metal polisher 10 is placed on the female die 24 of the pressure die set 20, with the surface on which the polishing teeth 3 are formed facing toward the female die 24. The male pressure die 22 is moved downward and the subsidiary female dies 24 are moved in the directions shown by arrows in FIG. 4. As a result, some of the polishing teeth 3 are partially crushed by the convex portions 25 formed on the female die 24, which leads to the formation of the concave grooves 4. In this operation, however, the polishing teeth 3 other than those crushed by the convex portions 25 maintain their original shape.

Figures 5, 6, 7:
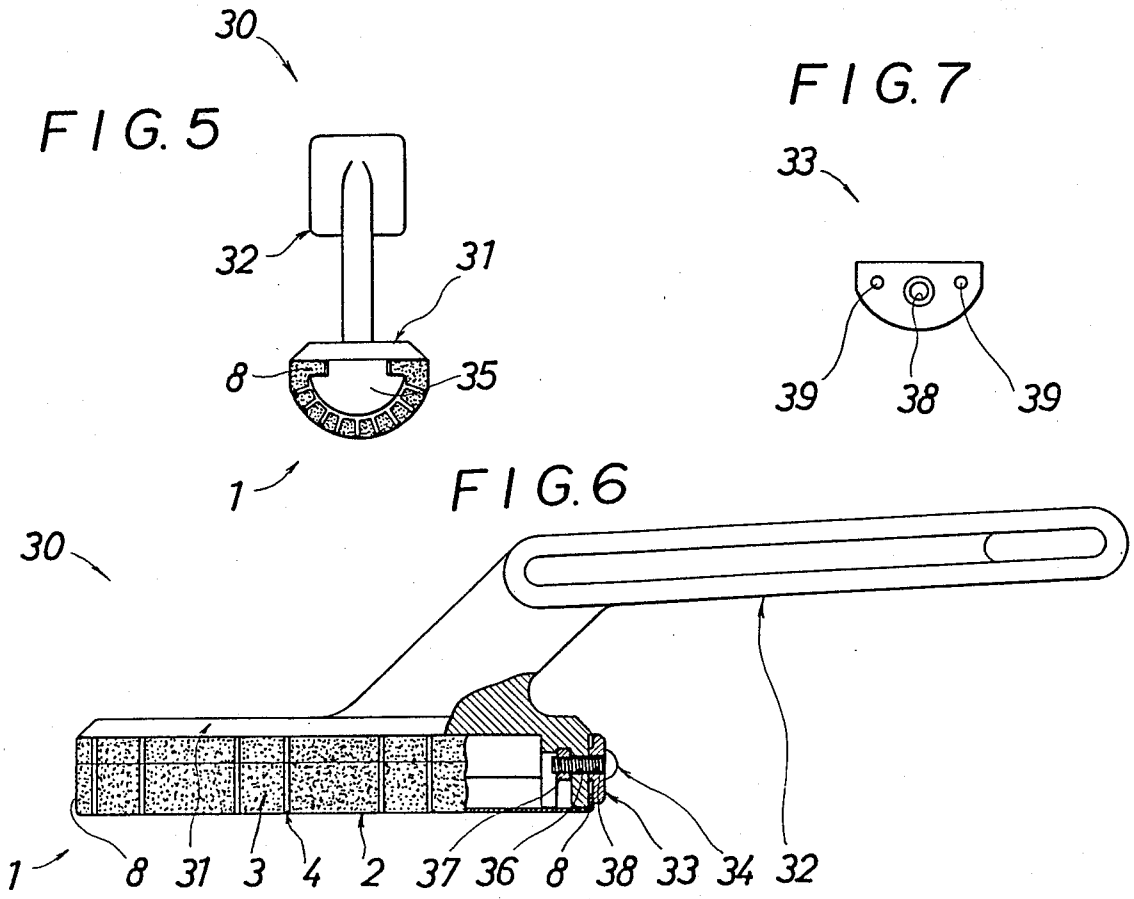
FIG. 5 is a front view showing a semi-cylindrical metal polisher mounted on a holder.
FIG. 6 is a side view, partly in section of the metal polisher shown in FIG. 5; and, FIG. 7 is a front view showing the seat of the holder.

The semi-cylindrical polishing element 1 thus formed serves as a means for polishing operations in which a support need not be used. However, both end faces of the flat metal polisher 10 are bent in the above-described pressure-application operation so that the shaped polisher is adapted to be mounted on a holder 30 as shown in FIGS. 5 through 7.

The holder 30 comprises a mounting element 31, a holding element 32 formed integrally with the mounting element 31, a seat 33 and a machine screw 34. The mounting element 31 is so structured that it outwardly mounts a semi-cylindrical polisher 1. Mounted on the mounting element 31, in the front portion thereof, is an engaging portion 35 which engages with the portion 8. In the rear portion of mounting element 31 is a through-hole 36 for receiving screw 34, and a nut 37 disposed adjacently to the through hole 36.

The holding element 32 extends backwardly diagonally from the upper portion of the mounting element 31 so as to be easily held by hand. It is formed integrally with the mounting element 31 and may be made of a synthetic resin.

The seat 33 is half disk-shaped and a hole 38 is provided at the center of the seat for receiving screw 34. At both sides of the hole 38 are engaging projections 39, made of a synthetic resin, which engage with the portion 8 of the semi-cylindrical metal polisher 1.

The mounting of the semi-cylindrical polisher 1 on the holder 30 is accomplished as follows. First, the front part of the bent portion 8 of the semi-cylindrical polisher 1 is engaged with the engaging portion 35 of the holder 30 so as to mount the semi-cylindrical polisher 1 outwardly on the mounting portion 31. Next, an engaging projection 39 of the seat 33 is abutted onto the rear part of the bent portion 8, and thereafter the machine screw 34 is inserted into the hole 38 of the seat 33 and the through hole 36 of the mounting portion 31. Thereafter, the machine screw 34 is screwed into the nut 37, which prevents the semi-cylindrical polisher 1 from being detached from the mounting portion 31 of the holder 30 in the longitudinal as well as in the vertical direction of the semi-cylindrical polisher 1.

The semi-cylindrical polisher 1 may be attached with either of its ends toward the front of the mounting portion 31 since the polisher 1 is symmetrical. Needless to say, the mounted semi-cylindrical polisher 1 is detachable from the holder by reversing the above-described procedure.

A polishing operation can be accomplished by grasping holder element 32 and moving the holder 30 with the teeth 3 of the semi-cylindrical polisher 1 engaging or abutting the workpiece. A similar result can be attained by the semi-cylindrical polisher 1 when it is detached from the holder 30.

Chips abraded from a workpiece as it is polished are temporarily stored in the concave grooves 4 or discharged from the concave grooves 4 after being stored therein.

While the polisher described above may be advantageously used to polish a workpiece having concave surfaces, it may also be used for polishing surfaces in convex, V-concave, or V-convex shapes.

While a specific preferred embodiment of the invention has been described in detail, various modifications may be made in the preferred embodiment without departing from the spirit and scope of the invention as defined by the appended claims. For example, the matrix 2 in the above-described embodiment has the bent portions 8 at its front and rear portions. However, the bent portions 8 may be formed at other portions or eliminated entirely.

In the preferred embodiment matrix 2 and polishing teeth 3 are not heat treated. If desired, only the face on which the polishing teeth are formed may be heat treated or the entire body may be heat-treated so as to be hardened. Needless to say, hardened polishing teeth are more durable than nonhardened polishing teeth.

The matrix 2 may be formed to be approximately semi-circular, V-shaped, or rectangularly shaped with one open side in cross-sectional view and need not have the approximate U-shape shown in above-described embodiment. Besides the above-described shapes, the matrix 2 can be formed into a hemicone which can be acquired by forming and cutting a cone into two parts in a direction transverse to its axis.

As a further modification of the preferred embodiment, polishing teeth 3 may be formed on the back side or both sides of the semi-cylindrical matrix unlike the above-described embodiment in which the polishing teeth 3 are formed only on the front surface of the matrix.

Polishing teeth 3 need not be formed in a semi-cylindrical pattern as in the above-described embodiment, but may be formed in other shapes, e.g., a paralleled or crossed hatched convex pattern. Also, the polishing teeth 3 need not be formed based on a predetermined arrangement, but may be formed at random.

What is claimed is:

1. A semi-cylindrical metal polisher made by the process comprising the steps of:

providing a flat metal matrix having a plurality of polishing teeth raised and integrally formed on a surface thereon;

shaping said flat metal matrix with a die set comprising a semi-cylindrical die having a plurality of circumferentially extending convex line portions on its face to thereby provide a semi-cylindrical metal matrix having a plurality of circumferential grooves on its surface with the polishing teeth present on said flat metal matrix in the regions of said convex line portions of said female die being crushed and flattened at the bottom of said grooves as said semi-cylindrical metal polisher is shaped.

* * * * *